US006141897A

United States Patent [19]

Bramer

[11] Patent Number: 6,141,897

[45] Date of Patent: Nov. 7, 2000

[54] BREECH PLUG

[75] Inventor: Jerald D. Bramer, Sidney, Nebr.

[73] Assignee: Cabela's Inc., Sidney, Nebr.

[21] Appl. No.: 09/272,224

[22] Filed: Mar. 18, 1999

[51] Int. Cl.[7] ..... F41A 17/00

[52] U.S. Cl. ..... 42/83

[58] Field of Search ..... 42/83, 51; 89/1.3

[56] References Cited

U.S. PATENT DOCUMENTS

| | | | |
|---|---|---|---|
| 6,139 | 2/1849 | Minesinger | 42/27 |
| 21,802 | 10/1858 | Schenkl | 42/51 |
| 1,226,443 | 5/1917 | Baker | 239/280 |
| 4,114,303 | 9/1978 | Vaughn | 42/51 |
| 4,123,866 | 11/1978 | Wiethoff | 42/77 |
| 4,163,335 | 8/1979 | Ives | 42/83 |
| 4,186,506 | 2/1980 | Pawlak et al. | 42/83 |
| 4,232,468 | 11/1980 | Chapin | 42/77 |
| 4,700,499 | 10/1987 | Knight | 42/51 |
| 5,010,677 | 4/1991 | Verney Carron | 42/77 |
| 5,016,379 | 5/1991 | Lambert | 42/83 |
| 5,133,143 | 7/1992 | Knight | 42/51 |
| 5,454,182 | 10/1995 | Lewis et al. | 42/51 |
| 5,561,934 | 10/1996 | Knight | 42/51 |
| 5,642,583 | 7/1997 | Ball et al. | 42/51 |
| 5,644,861 | 7/1997 | Knight | 42/51 |
| 5,651,203 | 7/1997 | Knight | 42/25 |
| 5,657,569 | 8/1997 | Jernigan et al. | 42/83 |
| 5,907,920 | 6/1999 | Laney | 42/83 |

FOREIGN PATENT DOCUMENTS

| | | | |
|---|---|---|---|
| 8573 | of 1840 | United Kingdom | 42/83 |

*Primary Examiner*—Charles T. Jordan
*Assistant Examiner*—Son T. Nguyen
*Attorney, Agent, or Firm*—Bachman & LaPointe, P.C.

[57] ABSTRACT

A breech plug for a black powder firearm is provided which breech plug has a chamber into which black powder, a black powder equivalent, or Pyrodex pellets is received and a flash channel for transmitting a flame to the chamber. The flash channel includes a linear portion which is at an angle of more than 0 degrees and less than 90 degrees with respect to a bottom wall of the chamber. In a preferred embodiment, the linear portion of the flash channel intersects the center of the bottom wall of the black powder chamber. The breech plug further has a threaded bore for receiving a nipple over which a percussion cap to be struck by a trigger actuated hammer is placed. The flash channel also includes a curved portion which extends between the bore and the linear portion.

6 Claims, 2 Drawing Sheets

BREECH PLUG

BACKGROUND OF THE INVENTION

The present invention relates to an improved breech plug for use in a black powder firearm such as a muzzleloading rifle.

Up until now in traditional black powder rifles, the flame from the percussion cap came through a flash channel at a right angle to the bottom of a breech plug. This has caused a number of problems. In all cases, it has slowed down the time that it took for the flame to get to the charge, which in turn increased the time it took from when the trigger was pulled until the charge went off. In all cases, when the flame got to the charge, it was not as strong or as hot as it needed to be for reliable ignition of the powder. Further, shooters were forced into using loose black powder or Pyrodex powder and were unable to take advantage of modern Pyrodex powder pellets. These modern pellets require the flame to hit them on their bottom in order to give reliable ignition of the pellet.

SUMMARY OF THE INVENTION

Accordingly, it is an object of the present invention to provide an improved breech plug for a black powder firearm.

It is yet another object of the present invention to provide a breech plug which has a smooth unimpeded course for the flame to take to the powder or pellets.

It is still another object of the present invention to provide a breech plug as above which shortens the travel time that the flame takes to the powder or pellets, thus speeding up the time from when the trigger is pulled until the gun goes off.

It is a further object of the present invention to provide a breech plug as above which allows the flame to reach the powder or pellets stronger and hotter for a more reliable ignition of the powder or pellets.

It is another object of the present invention to provide a breech plug as above which allows a user to use modern Pyrodex pellets.

The foregoing objects are attained by the breech plug of the present invention.

In accordance with the present invention, a breech plug is provided which has a chamber into which black powder, a black powder equivalent, or Pyrodex pellets is received and means for transmitting a flame to the chamber. The flame transmitting means includes a linear portion which is at an angle of more than 0 degrees and less than 90 degrees with respect to a bottom wall of the chamber. In a preferred embodiment, the linear portion of the flame transmitting means intersects the center of the bottom wall of the black powder chamber. The breech plug further has a threaded bore for receiving a nipple over which a percussion cap to be struck by the hammer is placed. The flame transmitting means includes a curved portion which extends between the bore and the linear portion.

Other details of the breech plug of the present invention, as well as other objects and advantages attendant thereto, are set forth in the following detailed description and the accompanying drawings in which like reference numerals depict like elements.

DETAILED DESCRIPTION OF THE PREFERRED EMBODIMENT(S)

As used herein, the term "black powder" shall include black powder, black-powder equivalents, and Pyrodex pellets.

Figure 1:
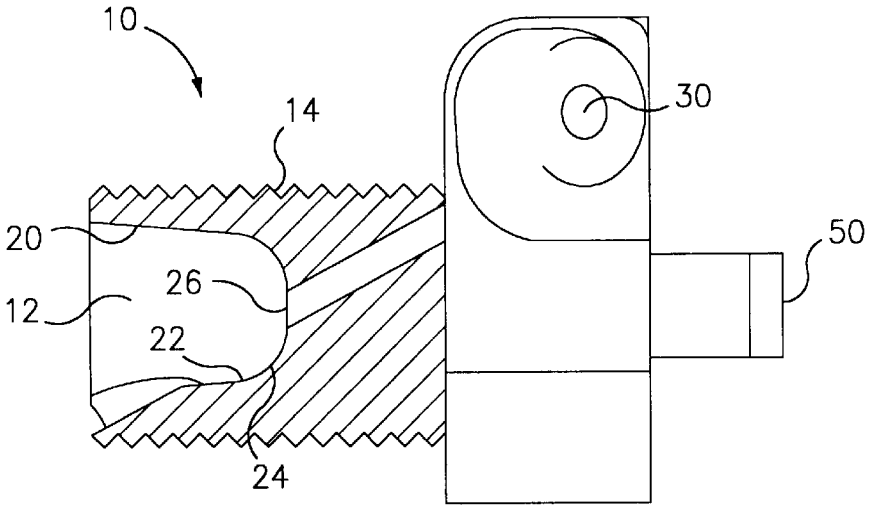
FIG. 1 is a partial sectional view of a breech plug in accordance with the present invention.
Figure 2:
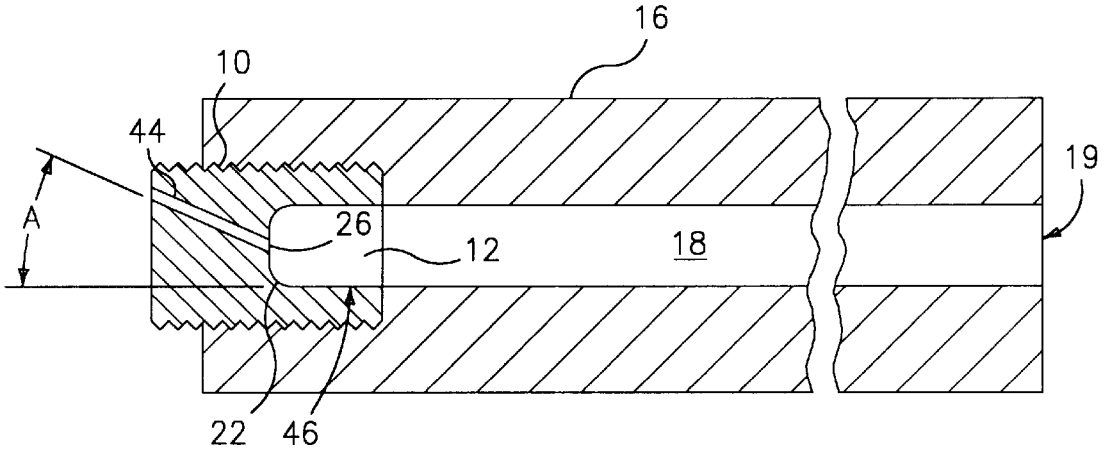
FIG. 2 is a side view of a firearm in partial cross section with the breech plug of the present invention installed.

Referring now to the drawings, FIG. 1 illustrates the breech plug 10 of the present invention. As shown therein, the breech plug 10 has a chamber 12 into which black powder is introduced. The breech plug 10 also has an external thread 14 which allows it to be threaded into an end of a gun barrel 16, as shown in FIG. 2, so that the chamber 12 is aligned with the bore 18 and the muzzle 19 of the gun barrel 16. Typically, the black powder, whether in loose form or in pellet form, is introduced into chamber 12 via the muzzle 19 and the bore 18.

The breech plug 10 of the present invention may be formed from any suitable material known in the art. For example, the breech plug 10 may be formed from steel.

Referring now to FIG. 1, it can be seen that the chamber 12 in the breech plug 10 has an open-ended cup shape and is formed by a top wall 20, a bottom wall 22, and an end wall 24. The end wall 24 has an aperture 26 through which the flame enters to contact the black powder.

Figure 3:
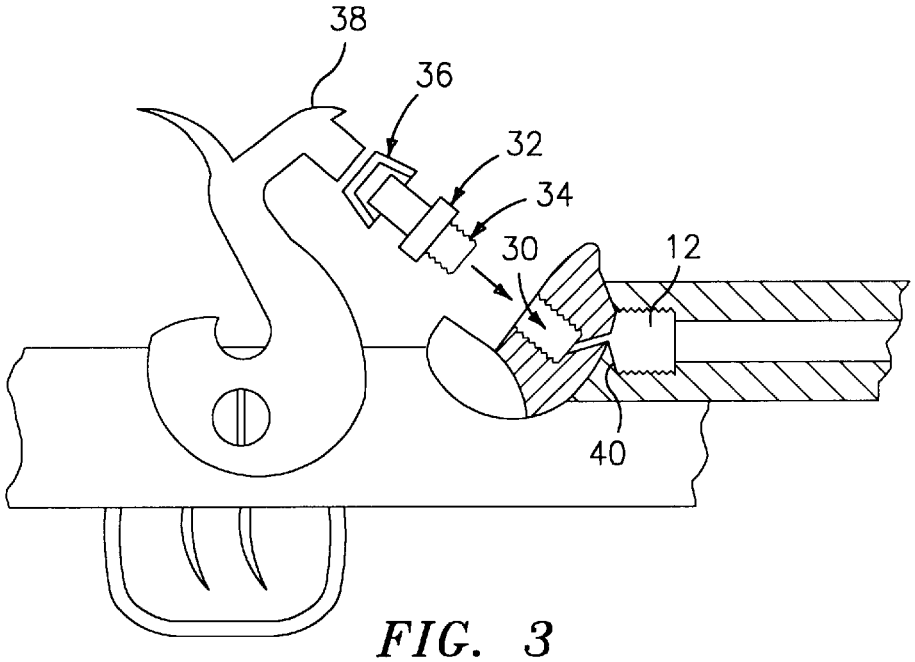
FIG. 3 is a side view of a firearm in partial cross section showing a hammer assembly for creating a flame and a percussion cap and nipple system to be used with the breech plug of the present invention.
Figure 4:
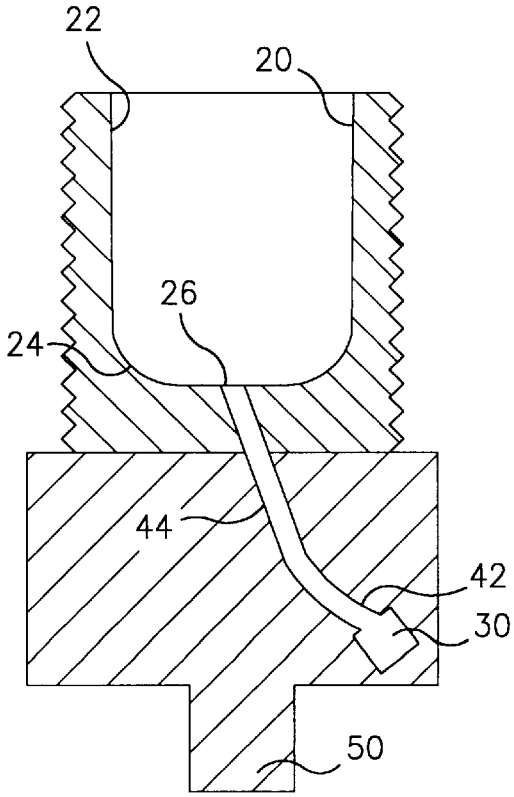
FIG. 4 is a sectional view of a breech plug in accordance with the present invention.

As shown in FIG. 3, the breech plug 10 further includes a threaded bore 30 into which a nipple 32 having a threaded end 34 is placed. The construction of the nipple 32 does not form part of the present invention. The nipple 32 may comprise any suitable nipple known in the art. For example, it may have a construction similar to the nipple shown in U.S. Pat. No. 5,133,143, which is incorporated by reference herein. In order to generate a flame to ignite the black powder in the chamber 12, a percussion cap 36 is placed over the nipple 32. Here again, the percussion cap 36 does not form part of the present invention and any suitable percussion cap known in the art may be used. A trigger actuated, spring loaded hammer 38, such as that shown in U.S. Pat. No. 5,657,569, which is incorporated by reference herein, is provided to strike the percussion cap 36 and thereby create a flame. The flame travels to the chamber 12 via a flash channel 40 which extends between the end of the bore 30 and the aperture 26. The flash channel 40, as shown in FIG. 4, has a curved portion 42 and a linear portion 44. The curved portion 42 provides a smooth transmission between the linear portion 44 and the bore 30. It should be appreciated that there are right-handed and left-handed black powder firearms. Depending on whether the gun is right-handed or left-handed, the bore 30 for receiving the nipple 32 would be on one side or the other. While this does not affect the linear portion 44 of the flesh channel 40, it will affect how the curved portion 42 curves.

As previously discussed, it is important in modern times for the flame to contact the bottom of the powder or pellets in the chamber 12. In order to do this, the flash channel 40 is provided with a linear portion 44 which is at an angle A of more than 0 degrees and less than 90 degrees with respect to the bottom wall 22. In a preferred embodiment of the present invention, the linear portion 44 is angled so that it is aligned with the center 46 of the wall 22, that is, if one were to extend the linear portion 44, it would intersect the center 46 of the wall 22. It has been found that by aligning the linear portion 44 in this manner, a smooth unimpeded course is provided for the flame to take to the powder. It also has been found that by providing a flash channel in accordance with the present invention, it takes a shorter time for the flame to get to the powder. This speeds up the time from when the trigger is pulled until the gun goes off, which also increases the accuracy of the shot. Still further, it has been found that by providing a flash channel in accordance with the present invention, the flame reaches the powder stronger and hotter, thus providing a more reliable ignition of the powder. Yet further, since the flame now enters the bottom center of the breech by using a breech plug in accordance with the present invention, the shooter can use the new Pyrodex pellets and get a reliable ignition of the pellets.

As shown in FIG. 1, the breech plug 10 also includes a tang lock stud 50 which is engaged by a tang (not shown) in the stock of the firearm. The tank lock stud 50 is provided to insure that the breech plug 10 is properly positioned within the stock of the firearm.

It is apparent from the foregoing description that in accordance with the present invention a breech plug has been provided which fully satisfies the means, objects, and advantages set forth hereinbefore. While the present invention has been described in the context of a preferred embodiment thereof, many alternatives, modifications and variations will be apparent to those skilled in the art after reading the instant specification.

Accordingly, it is intended to embrace such alternatives, modifications, and variations as fall within the broad scope of the appended claims.

What is claimed is:

1. A breech plug for a black powder firearm comprising:

a chamber for receiving a charge of black powder;

said chamber having a bottom wall;

means for transmitting a flame to said black powder in said chamber;

said transmitting means including a linear portion at an angle greater than 0 degrees but less than 90 degrees with respect to said bottom wall;

a threaded bore for receiving a threaded end of a nipple; and said flame transmitting means comprising an upper curved portion extending between an end of said bore and said linear portion.

2. The breech plug of claim 1, wherein said chamber has a cup shape and also has a top wall and an end wall; and wherein said end wall has an aperture for allowing said flame to enter said chamber.

3. The breech plug of claim 1, wherein said linear portion is aligned with the center of said bottom wall.

4. The breech plug of claim 1, wherein said upper curved comprises a smooth, curving channel.

5. The breech plug of claim 1, further comprising external thread means for allowing the plug to be inserted into and mated with a gun barrel having a bore and a muzzle.

6. The breech plug of claim 5, wherein said chamber is aligned with said bore and said muzzle to allow said powder to be introduced into said chamber via said bore and said muzzle.

* * * * *